United States Patent [19]

Harris et al.

[11] Patent Number: 4,727,351

[45] Date of Patent: Feb. 23, 1988

[54] HIGH POWER RF RESISTOR

[75] Inventors: Mark A. Harris; William E. Coleman, Jr., both of Clearwater; Joseph M. DeLeon, St. Petersburg; Eugene M. Littlefield, Redington Beach; Earnest A. Franke, Largo, all of Fla.

[73] Assignee: E-Systems, Inc., Dallas, Tex.

[21] Appl. No.: 65,392

[22] Filed: Jun. 23, 1987

[51] Int. Cl.[4] ..... H01C 1/012

[52] U.S. Cl. ..... 338/308; 338/309; 338/314; 338/320

[58] Field of Search ..... 338/308, 309, 314, 320, 338/333, 334; 29/610 R, 620, 621

[56] References Cited

U.S. PATENT DOCUMENTS

| | | | |
|---|---|---|---|
| 4,196,411 | 4/1980 | Kaufman | 338/314 |
| 4,199,745 | 4/1980 | Barry | 338/314 X |
| 4,300,115 | 11/1981 | Anjell et al. | 338/320 X |
| 4,486,738 | 12/1984 | Sadlo et al. | 338/309 X |

*Primary Examiner*—C. L. Albritton

*Attorney, Agent, or Firm*—Albert M. Crowder, Jr.

[57] ABSTRACT

A high power RF resistor for use, for example, as an isolation resistor in an RF hybrid splitter/combiner is formed on a thermally conductive substrate. A first insulating beryllia (BeO) layer extends over the substrate and has a top surface and a bottom surface. A first metallization layer extends over the top surface of the first insulating layer and includes a longitudinally-extending gap. A second insulating BeO layer is positioned above the first insulating layer and includes a top surface, a bottom surface and first and second side surfaces. A second metallization layer surrounds the bottom surface and the first and second side surfaces of the second insulating layer and has a longitudinally-extending gap, the gap in the second metallization layer positioned to be in alignment with the gap in the first metallization layer. This structure forms a Faraday shield between the resistive layer and ground to thereby reduce the $I^2R$ loss resulting from stray capacitance normally associated with isolation resistors. A thin film resistive layer extends over the second insulating layer to form the active resistor element. Preferably, inductors are connected between the terminals of the resistor and ground to tune out parasitic capacitance generated by the metallization layers.

18 Claims, 5 Drawing Figures

HIGH POWER RF RESISTOR

TECHNICAL FIELD

The present invention relates to resistive devices and more particularly to a high power RF resistor for use in an RF hybrid splitter/combiner circuit.

BACKGROUND OF THE INVENTION

High power RF amplifiers are configured using several smaller amplifiers connected by RF hybrid splitter/combiner circuits. One such RF power circuit is the Wilkinson hybrid which is composed of two transmission lines and an isolation resistor. The resistor is typically constructed with a thin film resistive element placed on an insulating beryllia (BeO) substrate. The BeO substrate acts as a dielectric which exhibits a parasitic distributive capacitance from the resistive element to ground.

In the Wilkinson hybrid, the resistor terminals are driven with common mode RF signals. Accordingly, because the distributive capacitance of the resistor is a low impedance at RF, current is shunted through the resistor to ground creating undesirable steady state power losses. Such losses reduce the efficiency of the hybrid, thereby degrading the overall performance of the RF amplifier.

There is therefore a need for an improved high power RF resistor which reduces inherent stray capacitance normally associated with the resistor when used for isolation purposes in an RF hybrid.

BRIEF SUMMARY OF THE INVENTION

According to the present invention, a high power RF resistor is described which exhibits reduced losses by controlling stray capacitance as compared to prior devices. In the preferred embodiment, the high power RF resistor is formed on a thermally conductive substrate. A first beryllia (BeO) insulating layer is provided extending over the substrate and has a top surface and a bottom surface. A first metallization layer extends over the top surface of the first insulating layer and has a longitudinally-extending gap. A second BeO insulating layer is positioned above the first insulating layer and has a top surface, a bottom surface and first and second side surfaces. The resistor also includes a second metallization layer extending over the bottom surface and the first and second side surfaces of the second insulating layer. The second metallization layer also includes a longitudinally-extending gap which is positioned over the gap in the first metallization layer. A thin film resistive layer extends over the second insulating layer, and first and second terminals are provided to couple an electrical signal to and from the resistive layer.

According to the invention, the gapped first and second metallization layers divide the insulating layer structure into first and second thermal paths located between the first and second resistor terminals, respectively, and ground. Because the capacitance associated with each thermal path between the gapped layer and the resistive element is reduced by driving both terminals with the same voltage, resistive losses resulting from the currents flowing in the stray capacitance are also reduced. The remaining current flowing between the gapped layer and the mounting surface is in a low loss dielectric, and the associated undesirable stray capacitances associated with this portion of the thermal paths are then tuned out of the circuit with shunt inductors connected to the resistor terminals.

BRIEF DESCRIPTION OF THE DRAWINGS

For a more complete understanding of the present invention and the advantages thereof, reference is now made to the Description taken in conjunction with the accompanying Drawings in which.

DETAILED DESCRIPTION

Figure 1:
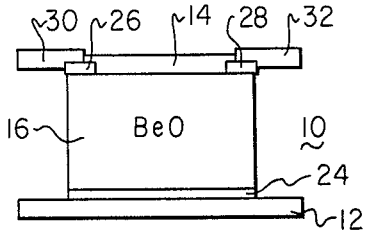
FIG. 1 (PRIOR ART)
FIG. 1 is a cross-sectional elevational view of a typical RF power resistor of the prior art.

With reference now to the drawings wherein like reference characters designate like or similar parts throughout the several views, FIG. 1 is a cross-sectional elevational view of a typical RF power resistor 10 of the prior art. Resistor 10 is formed on a thermally conductive substrate 12 and comprises a thin film resistive element 14 placed on an insulating layer 16 preferably formed of beryllia (BeO). The resistor 10 also includes a bottom metallization layer 24 located between the insulating layer 16 and the substrate 12, and first and second top metallization layers 26 and 28 extending over top edges of the insulating layer 16 to support the thin film resistive element 14. First and second terminals 30 and 32 are provided for use in coupling an electrical signal to and from the resistive element 14.

Figure 2:
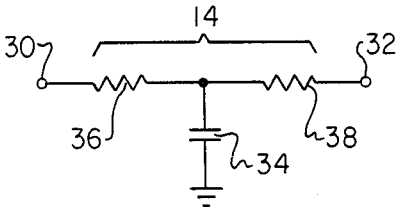
FIG. 2 is a schematic diagram of the RF power resistor of FIG. 1.

The BeO insulating layer 16 of resistor 10 provides a thermal path from the thin film resistive element 14 to the substrate 12. The BeO layer also acts as a dielectric which exhibits a parasitic distributed capacitance ($C_{stray}$) from the resistive element 14 to the substrate. As seen in FIG. 2, which is a schematic diagram of the resistor 10 of FIG. 1, the distributed capacitance $C_{stray}$ is modeled as a single lumped capacitor 34 connected to ground between a split resistor comprising elements 36 and 38.

In a conventional Wilkinson hybrid circuit, the resistor terminals 30 and 32 of the resistor of FIG. 1 are driven with common mode RF signals. Because $C_{stray}$ is a low impedance at RF, current is shunted through both of the R/2 value resistors 36 and 38, referring to FIG. 2, to ground, thereby causing undersirable steady state ($I^2R$) losses. According to the present invention, however, a resistor is provided which exhibits reduced $C_{stray}$ (and consequently reduced steady state power losses). This resistor is therefore useful in providing port-to-port isolation in a hybrid circuit, such as the Wilkinson hybrid.

Figure 3:
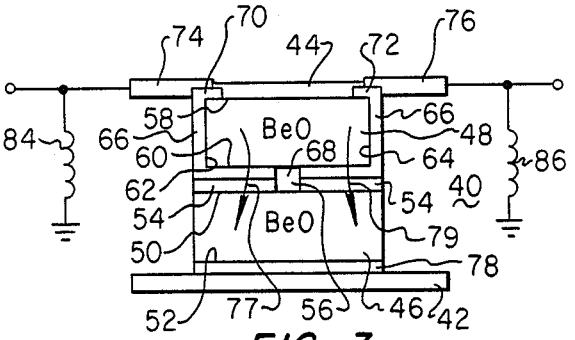
FIG. 3 is a cross-sectional elevational view of a high power RF resistor of the present invention showing its component layers.

Referring now to FIG. 3, a cross-sectional elevational view of a high power RF resistor 40 of the present invention is shown. Resistor 40 is formed on a thermally conducting substrate 42 and comprises a thin film resistive element 44 supported by first and second thin film insulating layers 46 and 48. The first and second insulating layers are preferably formed of beryllia (BeO) although other equivalent materials may be used. The first insulating layer 46 extends over the substrate 42 and has a top surface 50 and a bottom surface 52. As also seen in FIG. 3, a first metallization layer 54 extends over the top surface 50 of the first insulating layer 46 and includes a centrally-located gap 56 for the purposes to be described.

The second insulating layer 48 is positioned above the first insulating layer 46 and includes a top surface 58, a bottom surface 60 and first and second side surfaces 62 and 64. As also seen in FIG. 3, the resistor 40 includes a second metallization layer 66 surrounding the bottom surface 60 and the first and second side surfaces 62 and 64 of the second insulating layer. The second metallization layer 66 also includes a centrally-located gap 68 which is positioned over the gap in the first metallization layer when the first and second insulation layers 46 and 48 are assembled.

The second metallization layer includes first and second flange portions 70 and 72 extending over the edges of the top surface 58 of the second insulating layer 48. A first terminal 74 is connected to the resistive layer 44 by means of the first flange 70 of the second metallization layer 66. Likewise, a second terminal 76 is connected to the resistive layer 44 by means of the second flange portion 72. The first and second terminals 74 and 76 are provided to couple the resistor 40 into an electrical circuit. A third metallization layer 78 is provided between the bottom surface 52 of the first insulating layer 46 and the substrate 42.

The resistor shown in FIG. 3 advantageously reduces $C_{stray}$ normally associated with high power RF resistors of the prior art. This is accomplished by the gapped first and second metallization layers 54 and 66 which cooperate to divide the first and second insulating layer structure into first and second thermal paths designated by the arrows 77 and 79 in FIG. 3. The resulting structure forms a "Faraday" shield between the resistive layer 44 and the substrate 42.

Figure 4:
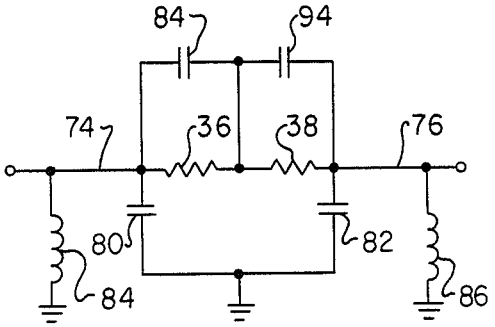
FIG. 4 is a schematic diagram of the high power RF resistor shown in FIG. 3.

Referring now to FIG. 4, which is a schematic diagram of the resistor 40 of FIG. 3, use of the Faraday shield creates two additional parasitic capacitances ($C_{Team}$) 80 and 82 in addition to the stray capacitances 84 and 94 (and resistive elements 36 and 38) as discussed about with respect to FIG. 2. In accordance with the invention, the undesirable effects of the two series capacitances 84 and 94 and the two shunt capacitances 80 and 82 are tuned out of the circuit with first and second shunt inductors 84 and 86. Preferably, the inductors 84 and 86 are implemented by either an RF choke or as a stripline or microstrip external to the resistor component described. The inductors 84 and 86 also advantageously serve to reduce susceptibility of the resistor to damage due to an electromagnetic pulse (EMP) by acting as a low reactance termination in the frequency region where the majority of the EMP spectral energy exits. Stray capacitance 34 to ground of FIG. 2 is replaced by capacitances 84 and 94 to the resistor terminals, eliminating the parasitic resistor current to ground resulting from common-mode voltages at the resistor terminals, thereby eliminating the common-mode power loss.

Figure 5:
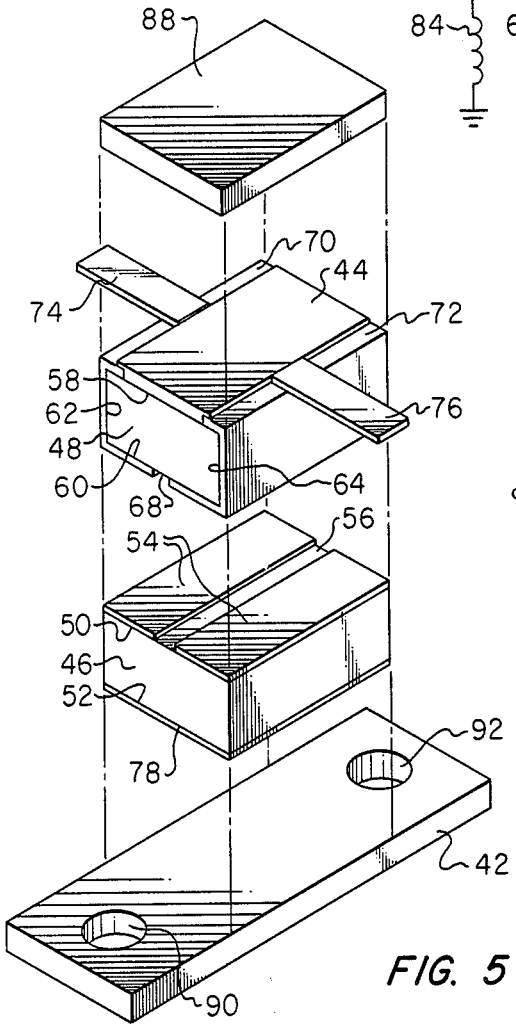
FIG. 5 is an exploded view of the preferred embodiment of the high power RF resistor shown in FIG. 3.

Referring now to FIG. 5, an exploded view is shown of the preferred embodiment of the high power RF resistor 40 described with reference to FIG. 3. As seen in this figure, the gaps 56 and 68 in the first and second metallization layers 54 and 66 preferably extend in a longitudinal direction with respect to the axis of the device. The final resistor also includes a ceramic lid 88 for protecting the components of the device and the thermally conductive substrate 42 preferably includes first and second apertures 90 and 92 for use in mounting the device to a printed circuit board.

Accordingly, the present invention relates to a high power RF resistor for use (by way of example only) as an isolation resistor in an RF hybrid. This resistor exhibits reduced $C_{stray}$ and steady state power losses as compared to prior art resistors. This operation is accomplished by using first and second gapped metallization layers which divide the supporting dielectric into first and second thermal paths located between the first and second resistor terminals, respectively, and ground. Parasitic capacitances associated with the first and second thermal paths are turned out of the circuit and therefore do not adversely affect the operation of the device.

Although the invention has been described and illustrated in detail, it is to be clearly understood that the same is by way of illustration and example only and is not to be taken by way of limitation. The spirit and scope of this invention are to be limited only by the terms of the appended claims.

We claim:

1. A high power resistor, comprising:
a thermally conductive substrate;
a first insulating layer extending over the substrate and having a top surface and a bottom surface;
a first metallization layer extending over the top surface of the first insulating layer and having a gap;
a second insulating layer above the first insulating layer and havaing a top surface, a bottom surface and first and second side surfaces;
a second metallization layer surrounding the bottom surface and the first and second side surfaces of the second insulating layer and including a gap, the gap in the second metallization layer positioned to be in alignment with the gap in the first metallization layer;
a resistive layer extending over the second insulating layer; and
means for coupling the resistive layer into an electrical circuit.

2. The high power resistor as described in claim 1, wherein the first and second insulating layers are formed of beryllia (BeO).

3. The high power resistor as described in claim 1 wherein the second metallization layer includes first and second flanges extending over the top surface of the second insulating layer.

4. The high power resistor as described in claim 3 wherein the resistive layer extends between the first and second flanges of the second metallization layer.

5. The high power resistor as described in claim 4 wherein the means for coupling includes first and second terminals connected to the resistive layer by the first and second flanges of the second metallization layer.

6. The high power resistor as described in claim 5 further including first and second shunt inductors connected to the first and second terminals, respectively, for reducing parasitic capacitance generated by the first and second metallization layers.

7. The high power resistor as described in claim 1 further including a third metallization layer between the bottom surface of the first insulating layer and the substrate.

8. A high power RF resistor, comprising:
a thermally conductive substrate;

a first insulating layer extending over the substrate and having a top surface and a bottom surface;

a first metallization layer extending over the top surface of the first insulating layer and having a longitudinally-extending gap;

a second insulating layer above the first insulating layer and having a top surface, a bottom surface and first and second side surfaces;

a second metallization layer surrounding the bottom surface and the first and second side surfaces of the second insulating layer and including a longitudinally-extending gap, the gap in the second metallization layer positioned to be in alignment with the gap in the first metallization layer;

a resistive layer extending over the second insulating layer; and first and second terminals connected to the resistive layer for coupling the resistive layer into an electrical circuit.

9. The high power RF resistor as described in claim 8 wherein the first and second insulating layers are formed of beryllia (BeO).

10. The high power RF resistor as described in claim 8 wherein the second metallization layer includes first and second flanges extending over the top surface of the second insulating layer.

11. The high power RF resistor as described in claim 10 wherein the resistive layer extends between the first and second flanges of the second metallization layer.

12. The high power RF resistor as described in claim 8 further including first and second shunt inductors connected to the first and second terminals, respectively, for reducing parasitic capacitance generated by the first and second metallization layers.

13. The high power RF resistor as described in claim 8 further including a third metallization layer between the bottom surface of the first insulating layer and the substrate.

14. A high power RF resistor for use in an RF hybrid splitter/combiner, comprising:

a thermally conductive substrate;

a first insulating BeO layer extending over the substrate and having a top surface and a bottom surface;

a first metallization layer extending over the top surface of the first insulating layer and having a longitudinally-extending gap;

a second insulating BeO layer above the first insulating layer and having a top surface, a bottom surface and first and second side surfaces;

a second metallization layer surrounding the bottom surface and the first and second side surfaces of the second insulating layer and including a longitudinally-extending gap, the gap in the second metallization layer positioned to be in alignment with the gap in the first metallization layer;

a resistive layer extending over the second insulating layer;

means for coupling the resistive layer into an electrical circuit; and means connected to said coupling means for reducing parasitic capacitance generated by the first and second metallization layers.

15. The high power RF resistor as described in claim 14 wherein the second metallization layer includes first and second flanges extending over the top surface of the second insulating layer.

16. The high power RF resistor as described in claim 15 wherein the resistive layer extends between the first and second flanges of the second metallization layer.

17. The high power RF resistor as described in claim 14 wherein the means for coupling includes a first and second terminals connected to the resistive layer by the first and second flanges of the second metallization layer.

18. The high power RF resistor as described in claim 14 further including a third metallization layer between the bottom surface of the first insulating layer and the thermally conductive substrate.

* * * * *